US008763424B1

(12) United States Patent
Albertson

(10) Patent No.: US 8,763,424 B1
(45) Date of Patent: Jul. 1, 2014

(54) SUBCOOLING HEAT EXCHANGER ADAPTED FOR EVAPORATOR DISTRIBUTION LINES IN A REFRIGERATION CIRCUIT

(71) Applicant: Heat Pump Technologies, LLC, Franklin, IN (US)

(72) Inventor: Luther D. Albertson, Sellersburg, IN (US)

(73) Assignee: Heat Pump Technologies, LLC, Franklin, IN (US)

( * ) Notice: Subject to any disclaimer, the term of this patent is extended or adjusted under 35 U.S.C. 154(b) by 0 days.

(21) Appl. No.: 14/041,124

(22) Filed: Sep. 30, 2013

(51) Int. Cl.
*F25B 1/00* (2006.01)

(52) U.S. Cl.
USPC ..... 62/498

(58) Field of Classification Search
USPC ..... 62/324.1, 498, 515
See application file for complete search history.

(56) References Cited

U.S. PATENT DOCUMENTS

| | | | | |
|---|---|---|---|---|
| 2,144,898 | A | | 1/1939 | Shrode |
| 2,353,240 | A | | 7/1944 | Huggins |
| 3,120,743 | A | | 2/1964 | Wilson |
| 3,552,140 | A | * | 1/1971 | Palmer ..... 62/324.4 |
| 3,958,028 | A | * | 5/1976 | Burg ..... 426/418 |
| 4,061,483 | A | * | 12/1977 | Burg ..... 62/268 |
| 4,685,305 | A | * | 8/1987 | Burg ..... 62/78 |
| 5,842,351 | A | | 12/1998 | Earhart, Jr. |
| 6,023,940 | A | | 2/2000 | Abbott et al. |
| 8,235,101 | B2 | | 8/2012 | Taras et al. |
| 8,485,248 | B2 | | 7/2013 | Coyle et al. |
| 2007/0023172 | A1 | | 2/2007 | Obrist et al. |
| 2010/0313585 | A1 | | 12/2010 | Parker et al. |
| 2011/0203308 | A1 | | 8/2011 | Chiang et al. |

* cited by examiner

*Primary Examiner* — Melvin Jones
(74) *Attorney, Agent, or Firm* — Woodard, Emhardt, Moriarty, McNett & Henry LLP

(57) ABSTRACT

Disclosed are embodiments of a subcooling heat exchanger adapted for evaporator distribution lines operating in a closed refrigeration circuit. Embodiments include heat exchangers having a first flow path upstream from a metering device carrying a working fluid at a higher temperature exchanging heat with the working fluid downstream from the metering device in one or more separate second lower temperature distribution flow paths leading to a downstream evaporator.

26 Claims, 11 Drawing Sheets

SUBCOOLING HEAT EXCHANGER ADAPTED FOR EVAPORATOR DISTRIBUTION LINES IN A REFRIGERATION CIRCUIT

BACKGROUND

Air-source heat pumps are a common heating source in the southern United States and in many places around the globe. Heat pumps collect and move heat into an enclosed space in the heating mode, or expel heat from the enclosed space in the cooling mode. Heat pump systems use a closed refrigeration circuit for circulating a working fluid or refrigerant to move thermal energy through the circuit by collecting it in one part of the circuit and moving it to another.

For example, a refrigeration circuit can use a compressor to raise the temperature and pressure of the refrigerant before delivering it to a condensing unit. Heat is dissipated from the condensing unit as the refrigerant condenses and changes phase from a hot high-pressure vapor to a warm high-pressure liquid. The high pressure warm refrigerant may then pass through a metering device (also called an "expansion valve") which can reduce the pressure of the working fluid before it enters an evaporating unit. Because of this pressure reduction, the working fluid changes phase from a warm high-pressure liquid to a two-phase mixture of liquid and vapor at a lower temperature and pressure. During this phase change, some of the warm liquid condensate quickly boils away (or "flashes") to a gas thereby absorbing enough heat from the working fluid to cool the remaining liquid. The remaining liquid then evaporates by absorbing heat from an external medium outside the evaporator such as air, the ground, a supply of fluid such as water, or some other heat source. The evaporated refrigerant reenters the compressor, and the cycle is repeated during normal operations.

In most residential settings, a heat pump system can either heat or cool an enclosed space by selectively controlling the flow of refrigerant using one or more valves and by using reversible metering devices in the circuit. These metering devices are configured to cause a substantial pressure reduction if working fluid flows one way while allowing the fluid to pass without a substantial pressure reduction if the fluid flows in the opposite direction. Typically this substantial pressure reduction occurs when the working fluid passes downstream from a metering device into a nearby heat exchanger (positioned either inside or outside the enclosed space). Thus in most such systems the heat exchanger immediately downstream from the metering device is operating as an evaporator collecting heat energy from an external medium to evaporate the refrigerant. In the cooling mode, the heat exchanger operating as an evaporator is positioned indoors to collect heat from within the enclosed space so that it may be moved along the circuit and expelled outside the enclosed space through another heat exchanger operating as a condenser. On the contrary, in the heating mode, the heat exchanger operating as an evaporator is positioned outdoors to collect heat from outside the enclosed space so that the heat may be moved through the circuit and expelled indoors through the other indoor heat exchanger now operating as a condenser. Thus such systems are "reversible" in that the indoor and outdoor heat exchangers can alternately operate either as an evaporator or a condenser depending on whether the system is operating in a heating mode or cooling mode.

In such heat pump systems, multiple metering devices can regulate the flow of the working fluid using a sensing device to detect the temperature of the working fluid vapors leaving the evaporator. The metering device can respond by opening when vapors leaving the evaporator are too hot, thus allow more refrigerant into the evaporator lowering its temperature, or by closing when the vapors are too cold to keep the quantity of refrigerant lower and temperatures higher. In this way, metering devices can control the temperature of the evaporator by regulating the flow of refrigerant into the evaporator depending on the load on the system and the rate of evaporation. Metering devices can then be calibrated according to the working fluid in use and the application of the refrigeration circuit (heating or cooling) to ensure working fluid in the liquid phase does not enter the compressor which can damage it.

As described above, some amount of working fluid immediately boils away when the metering device reduces the pressure because the working fluid cannot remain a liquid at a temperature higher than the boiling temperature corresponding to the lower pressure in the evaporator. The warm condensed liquid can no longer remain a liquid at the reduced pressures causing some part of the condensed liquid to evaporate and cool the remaining fluid in the liquid phase.

Situations can arise where this phase change may occur before the working fluid enters the metering device. This can occur, for example if the warm condensed liquid decreases in pressure or increases in temperature as it passes through the lines leading from the condenser to the metering device upstream from and adjacent to the evaporator. Even though these changes may be minor, they may be sufficient to cause vapor phase working fluid bubbles to form within the lines leading to the metering device thus causing gas to enter and pass through the metering device.

Such situations are usually disadvantageous to the smooth functioning of the refrigeration circuit. When a two-phase mixture of liquid and gas working fluid enters the metering device, the hotter gases generally pass quickly through the evaporator and into the compressor. The temperature sensor at the evaporator outlet may sense the higher temperature of the passing vapor and cause the metering device to react quickly as if a large heat load were suddenly present thus allowing a surge of condensed liquid into the evaporator. However, just as quickly, the bubble of hot vapor moves past the sensor, and the cooler evaporated vapor moves by the sensor causing the metering device to quickly close again. If the cause of the vapor phase bubbles in warm condensate is not remedied, high temperature vapor pockets may continue to pass through the evaporator at irregular intervals causing a frequent and erratic opening and closing of the metering device. Such a condition is sometimes referred to as "a hunting expansion valve" condition causing continuous overfeeding and starving of the refrigerant flow to the evaporator. This can result in erratic performance, abnormal wear on the metering device, and inefficiencies in overall performance of the system.

SUMMARY

Disclosed are various embodiments of a subcooling heat exchanger configured to reduce or eliminate vapor in the liquid condensate leading to the metering device by exchanging heat between the warm condensate entering the metering device, and the cooler two-phase mixture of liquid and gas working fluid distributed to the evaporator through one or more distribution lines downstream from the metering device. Heat from the warm condensed working fluid is transferred into the cooler two-phase mixture of liquid and vapor passing from the metering device to the evaporator. Thus the temperature differential between the fluid entering the metering device, and the fluid in the vapor mixture leaving the metering device is reduced enough to cause most if not all of any vapor phase working fluid in the warm condensed liquid upstream from the metering device to recondense to a liquid. In this way, little if any vapor phase working fluid passes through the metering device eliminating most if not all of the negative affects this condition can cause.

One example of a subcooling heat exchanger using several evaporator distribution lines is included with a compressor, a condenser, a metering device, and an evaporator coupled together to form a closed refrigeration circuit for circulating a working fluid. The subcooling heat exchanger is located upstream from the evaporator, the heat exchanger defining a first flow path carrying a working fluid from the condenser to the metering device, and several separate second flow paths carrying the working fluid from the metering device through the heat exchanger to the evaporator, the working fluid in the first flow path exchanging heat with the working fluid in the second flow paths.

In a second example, a subcooling heat exchanger having all the features of the first example further comprises a distributor downstream from the metering device receiving a liquid and a vapor phase working fluid from the metering device, the distributor having a mixing device for creating a mixture of the liquid and the vapor phase, and a flow divider for distributing the mixture to several conduits defining the second flow paths.

In a third example, a subcooling heat exchanger is positioned between a metering device and a distributor along with a compressor, a condenser, a metering device, and an evaporator coupled together to form a closed refrigeration circuit for circulating a working fluid. The heat exchanger defines a first higher temperature flow path carrying the working fluid from the condenser to the metering device, and a separate second lower temperature flow path carrying the working fluid in a liquid and a vapor phase from the metering device through the heat exchanger to the evaporator, the working fluid in the first flow path exchanging heat with the working fluid in the separate second flow path. Also included is a distributor downstream from the metering device receiving the liquid and vapor phase working fluid from the second lower temperature flow path, the distributor having a mixing device for creating a mixture of the liquid and vapor phase, and a flow divider for distributing the mixture to several conduits upstream from the evaporator.

In a fourth example, a subcooling heat exchanger using at least one evaporator distribution line is included with a compressor, a condenser, a metering device, and an evaporator coupled together to form a closed refrigeration circuit for circulating a working fluid. A distributor downstream from the metering device receives a liquid and vapor phase working fluid from the metering device. The distributor includes a mixing device for creating a mixture of the liquid and vapor phase, and a flow divider for distributing the mixture to the evaporator downstream from the distributor through one or more separate distribution flow paths. A heat exchanger is also included that defines a first higher temperature flow path carrying the working fluid from the condenser to the metering device and the working fluid in the first higher temperature flow path exchanges heat with the working fluid in at least one of the one or more separate distribution flow paths passing through the heat exchanger.

Further forms, objects, features, aspects, benefits, advantages, and embodiments will become apparent from the included detailed description and drawings.

DETAILED DESCRIPTION

Figure 1A:
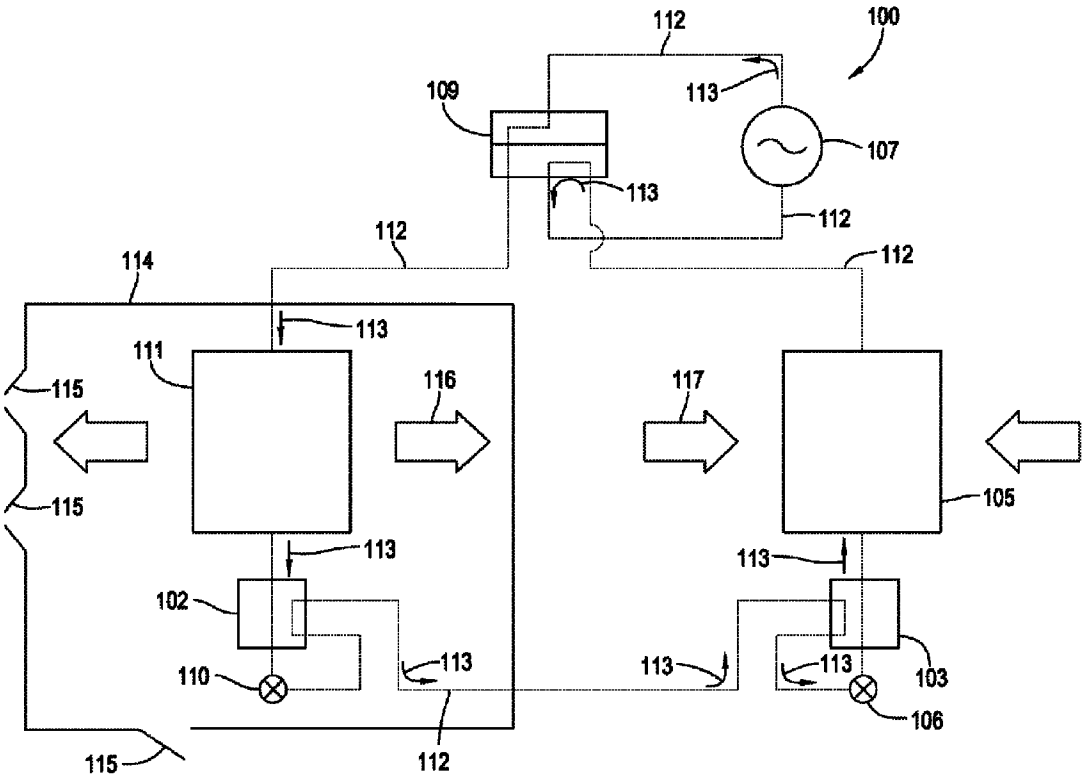
FIG. 1A is a schematic view of a reversible heat pump system using a closed refrigeration circuit having subcooling heat exchangers operating in the heating mode.

As noted above, included herein are various embodiments of a closed refrigeration circuit operating in either the heating or the cooling mode (such as a reversible heat pump or air conditioner) that include components configured to exchange heat between a relatively cool working fluid entering the evaporator through several conduits, and the relatively warm condensed working fluid entering the expansion or metering device. In exchanging heat between warm condensed fluid and the cooler fluid moving into the evaporator, the temperature of the fluid entering the metering device is reduced, at least enough to reduce or preferably eliminate the vapor phase working fluid bubbles that have formed in the line leading to the metering device.

The disclosed embodiments increase the operating efficiency of the metering device, and the system as a whole, by using a subcooling heat exchanger that is upstream from the warm, high pressure inlet of the metering device and downstream from the cool, low pressure outlet of the metering device as well. The subcooling heat exchanger is configured to exchange heat between the warm condensed fluid and the cooler two-phase liquid and vapor combination passing from the metering device outlet into the evaporator through one or more conduits. An optional distributor may be used to evenly distribute the liquid and vapor mixture to various conduits leading to various parts of the evaporator. These conduits define one or more flow paths from the distributor into the evaporator, some or all of which may pass through the heat exchanger. Thus vapor in the line leading into the metering device can be eliminated by cooling the condensed liquid working fluid using the reduced temperature of the two-phase mixture of liquid and vapor phase working fluid passing through the conduits into the evaporator.

By exchanging heat from the condensed liquid upstream from the metering device as disclosed and shown in the illustrated embodiments, issues such as the hunting expansion valve condition can be reduced or eliminated without the need for additional cooling circuits having additional heat exchangers, compressors, and the like. Using the heat exchangers disclosed below, the temperature of the condensed liquid can be reduced causing some or all of the vapor phase working fluid upstream from the metering device to recondense to a liquid phase before experiencing a pressure drop in the metering device and entering the evaporator. In some cases, only a very small amount of heat may need to be extracted from the warm condensate to cause the recondensation of the vapor phase bubbles. For example cooling the liquid entering the metering device by less than 10 degrees Fahrenheit may eliminate most if not all of the vapor in the condensate. However, higher or lower amounts may be desirable as well.

The disclosed embodiments, as mentioned above, may be used to reduce or eliminate situations such as a hunting valve condition in reversible heat pump systems operating in both the heating and in the cooling mode. The disclosed embodiments may also be used for a similar purpose in a refrigeration circuit that is not reversible, such as, an air conditioner which is an example of a closed refrigeration circuit configured to operate only in the cooling mode. In such systems it is generally advantageous to cool the condensed liquid and reject the waste heat before it enters the evaporator. This is done to keep additional heat out of the evaporator in the cooling mode so that maximum heat absorption can occur in the evaporator to cool the enclosed space.

It is fundamental to the operation of an air conditioner, or a reversible heat pump operating in the cooling mode, to remove as much heat from the load (e.g. the enclosed space) as possible by maintaining a large temperature differential between the liquid in the evaporator and the load. The disclosed embodiments, on the other hand, operate to collect heat from the warm condensed liquid entering the metering device and transfer it to the evaporating liquid, thus having the opposite effect of introducing heat into the evaporator that is not from the load. This additional heat is commonly the result of work performed by the compressor and is the same heat commonly heat rejected from the condensed liquid by subcooling systems. Rejecting rather than collecting this heat is advantageous in the cooling mode because introducing additional heat into the evaporator from any source other than the load degrades the evaporator's ability to cool the load (as opposed to an evaporator operating in the heating mode were adding heat to the evaporating liquid is advantageous, regardless of the source).

However, although adding heat to an evaporator configured for cooling (e.g. positioned indoors) reduces its ability to absorb available heat from the air or liquid load, it may be advantageous to use the disclosed heat exchangers because the potential introduction of additional heat into the evaporator may be very minor, and doing so may reduce or eliminate a hunting expansion valve problem, or other similar problem caused by vapor in the liquid entering the metering device. Therefore even in the cooling mode, it may be advantageous to introduce some heat into the evaporator to increase the overall efficiency of the refrigeration circuit. Therefore the disclosed embodiments can be arranged and configured to reduce the likelihood of vapor phase bubbles arriving at the metering device in a reversible heat pump system operating in either the heating or the cooling mode, or in a non-reversible closed refrigeration circuit as well.

Other techniques for achieving subcooling are available, but generally require increased installation and maintenance cost due to additional complexity, such as adding a dedicated heat exchanger having an outside or separate cooling circuit and cooling medium on the downstream side of the condenser prior to the expansion device. This heat exchanger may be configured to exchange heat between the warm condensate and an external medium such as the air, ground, or perhaps a liquid bath containing water, brine, or other cool fluids. Further subcooling can be achieved in some systems using a powered secondary cooling system in a heat exchange relationship with the warm condensate. Such systems are often used in cryogenic cooling systems or low-temperature refrigeration systems such as in supermarket refrigerators and freezers. However, powered subcooling equipment creates additional complexity and cost both to install and operate making it prohibitively expensive for most residential and commercial applications.

Reference will now be made to the embodiments illustrated in the drawings, and specific language will be used to describe the same. It will nevertheless be understood that no limitation of the scope of the invention is thereby intended. Any alterations and further modifications in the described embodiments and any further applications of the principles described herein are contemplated as would normally occur to one skilled in the art to which the disclosure relates. Several embodiments are shown in great detail, although it will be apparent to those skilled in the relevant art that some, less relevant features may not be shown for the sake of clarity.

Reference numerals in the following description have been organized to aid the reader in quickly identifying the drawings where various components are first shown. In particular, the drawing in which an element first appears is typically indicated by the left-most digit(s) in the corresponding reference number. For example, an element identified by a "100" series reference numeral will first appear in FIG. 1, an element identified by a "200" series reference numeral will first appear in FIG. 2, and so on. With reference to the Specification, Abstract, and Claims sections herein, it should be noted that the singular forms "a", "an", "the", and the like include plural referents unless expressly discussed otherwise. As an illustration, references to "a device" or "the device" include one or more of such devices and equivalents thereof.

Figure 1B:
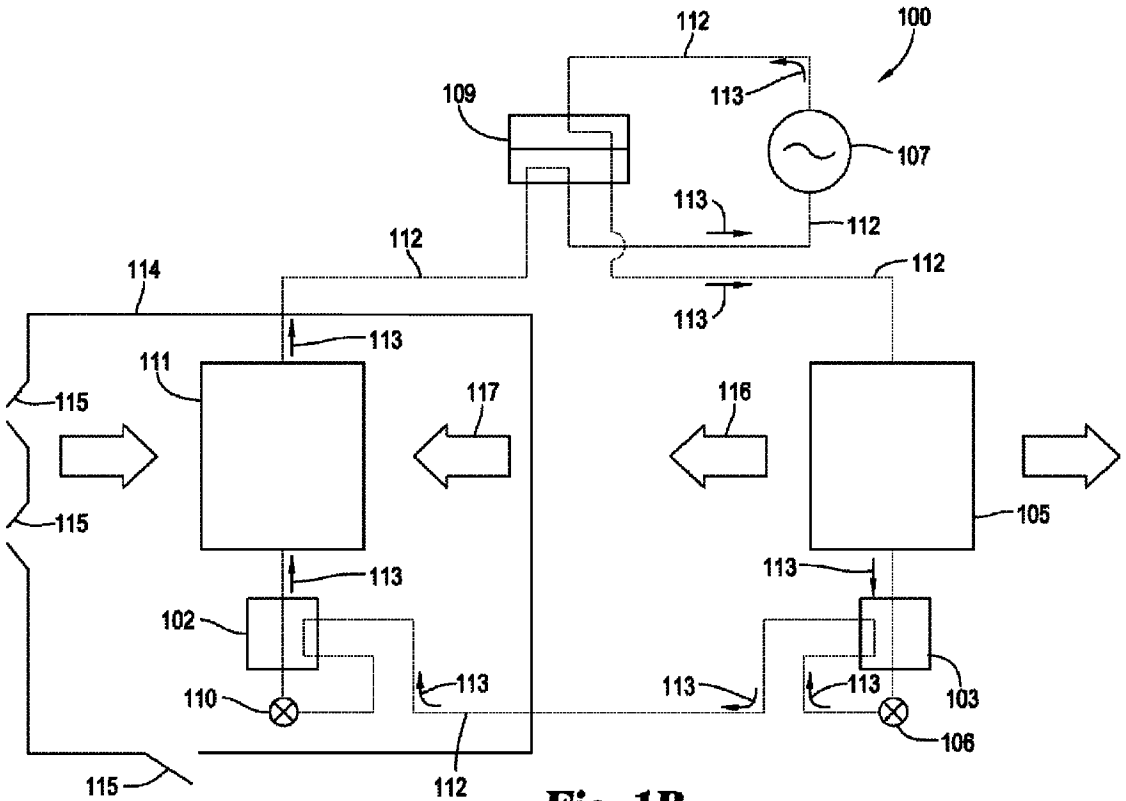
FIG. 1B is a schematic view of the reversible heat pump system of FIG. 1A operating in the cooling mode.

FIGS. 1A and 1B illustrate in schematic form examples of a reversible heat pump system 100 operating in the heating (FIG. 1A) and cooling (FIG. 1B) modes using the disclosed subcooling heat exchanger. In FIG. 1A uses a closed refrigeration circuit for circulating a working fluid or refrigerant 113 that includes a compressor 107 situated upstream from a reversing valve 109 capable of reversing the flow of working fluid 113. Downstream from reversing valve 109 is an indoor heat transfer unit 111 operating in the heating mode as a condenser for rejecting heat of condensation 116 into an enclosed space 114 to raise the ambient air temperature inside enclosed space 114. Working fluid 113 then moves downstream through a first higher temperature flow path in a first heat exchanger 102 before entering a reversible metering device 110. Upon leaving reversible metering device 110, working fluid 113 passes back through a second separate (also relatively high temperature flow path) in first heat exchanger 102 before continuing on to a second heat exchanger 103 upstream from an outdoor heat transfer unit 105 operating as an evaporator.

In FIG. 1A, first heat exchanger 102 provides little if any actual heat exchange because the working fluid 113 in both the first and second flow paths is substantially the same temperature. This is because reversible metering device 110 in the heating mode is not preparing working fluid 113 for delivery into a heat transfer unit operating as an evaporator and therefore is configured to allow working fluid 113 to bypass the pressure reduction components of reversible metering device 110. Without a substantial change in pressure to cause the expansion and resulting cooling of working fluid 113, no substantial difference in temperature occurs across the first flow path in first heat exchanger 102.

Working fluid 113 leaves first heat exchanger 102 and enters second heat exchanger 103, still as a relatively warm high pressure condensed fluid, primarily a liquid although some vapor may also be present. As with first heat exchanger 102, working fluid 113 moves through a first higher temperature flow path defined by second heat exchanger 103 before entering a reversible metering device 106. However, unlike reversible metering device 110, reversible metering device 106 in the heating mode is configured to prepare working fluid 113 for delivery into a heat transfer unit (105) operating as an evaporator and therefore operates to reduce the pressure of working fluid 113 as it passes through the reversible metering device 106.

This reduction in pressure causes working fluid 113 to cool while experiencing at least a partial phase change resulting in a liquid phase and vapor phase moving downstream from reversible metering device 106. The two-phase working fluid 113 reenters and passes through a separate second lower temperature flow path (or several of them) also defined within second heat exchanger 103. Heat transfers between the separate flow paths as heat from the warmer condensed working fluid in the first higher temperature flow path warms the lower temperature two-phase liquid and vapor combination passing through the separate second lower temperature path or paths. This has the effect of cooling the working fluid 113 entering reversible metering device 106, if only by a few degrees, causing vapor phase working fluid in lines 112 upstream from reversible metering device 106 to recondense to a fluid so that working fluid 113 contains little if any vapor phase working fluid as it enters reversible metering device 106.

The cooler lower pressure liquid and vapor phase working fluid 113 continues downstream to outdoor heat transfer unit 105 operating in the heating mode as an evaporator for collecting heat of evaporation 117 from an external medium (for example, ambient air, the ground, or some other heat source). As that heat of evaporation 117 is absorbed by the working fluid 113 in outdoor heat transfer unit 105, the working fluid continues to change phase from a liquid to a vapor carrying with it the latent heat of evaporation 117 collected from the external medium.

The evaporated working fluid 113 completes a trip through the refrigeration circuit when it enters compressor 107 as a vapor via reversing valve 109 carrying vapor downstream from outdoor heat transfer unit 105. As shown, the closed refrigeration circuit includes a number of fluid conduits or lines 112 for carrying working fluid 113 between the various components of reversible heat pump system 100. Lines 112 couple the compressor 107, reversing valve 109, indoor heat transfer unit 111, first heat exchanger 102, metering device 110, second heat exchanger 103, reversible metering device 106, and outdoor heat transfer unit 105 as illustrated thus completing the closed reversible refrigeration circuit. Other components may also be included in the closed refrigeration circuit as well although they may be omitted from FIG. 1A (or FIG. 1B) for clarity.

Because FIGS. 1A and 1B are schematic in nature, it should not be assumed that lines 112 passing between components in the reversible heat pump system 100 comprise only a single physical tube, conduit, or other fluid carrying structure for passing working fluid 113 through the system. As will be indicated in detail in later drawings, some lines, such as those passing between heat exchangers 102, indoor heat transfer unit 111, and metering device 110, may include multiple conduits defining multiple flow paths. A similar arrangement may also exist for the lines connecting reversible metering device 106, second heat exchanger 103, and outdoor heat transfer unit 105. Multiple lines may also be used in other parts of the circuit as well.

As discussed above, a closed refrigeration circuit such as the refrigeration circuit used by reversible heat pump system 100 is said to be "reversible" because it includes components (such as reversing valve 109, and reversible metering devices 110 and 106) capable of selectively reversing the flow of the working fluid through the system. By changing the direction of flow of compressed working fluid 113 through lines 112, reversing valve 109 can alter the roles of indoor heat transfer unit 111 and outdoor heat transfer unit 105. Reversible metering devices 110 and 106 facilitate and augment this process by allowing a pressure drop to occur across the individual metering devices as the fluid flows in one direction but not the other. However, it should be appreciated that heat exchangers 102 and 103 may be used individually in similar closed refrigeration circuits dedicated to operate only in the heating or the cooling mode. Such systems would only pressurize working fluid 113 to flow in one direction, without the need for reversing valve 109 thus making one or the other of metering devices 106 and 110 unnecessary. For example, the system shown in FIG. 1A could be configured to always run in the heating mode by removing reversing valve 109 and coupling the compressor 107 output directly to the inlet of the indoor heat transfer unit 111. Also, reversible metering device 110 and first heat exchanger 102 could be removed in this example allowing the working fluid to move directly from indoor heat transfer unit 111 to downstream second heat exchanger 103. Thus the benefits of the heat exchange within second heat exchanger 103 may be obtained in a closed refrigeration circuit configured only for heating.

Illustrated in FIG. 1B is the reversible heat pump system 100 with the closed refrigeration circuit of FIG. 1A operating in the cooling mode. Reversing valve 109 is configured to reverse the flow of working fluid 113 through the closed refrigeration circuit to cool the enclosed space 114 rather than heat it as discussed above. Heat of condensation 116 is rejected from outdoor heat transfer unit 105 into an external medium (for example, ambient air) causing the compressed working fluid vapor 113 to condense into a warm liquid. The warm liquid working fluid 113 passes downstream through reversible metering device 106 which operates like reversible metering device 110 does in the heating mode. Because reversible metering device 106 need not prepare working fluid 113 for evaporation, working fluid 113 passes through metering device 106 without experiencing any substantial change in pressure. This means working fluid 113 entering and leaving reversible metering device 106 are at substantially the same temperature. Therefore working fluid 113 passes through the first and second flow paths defined by second heat exchanger 103 with little if any heat exchange occurring (similar to first heat exchanger 102 operating in the heating mode). Thus in the cooling mode, outdoor heat transfer unit 105 operates as a condenser and indoor heat transfer unit 111 operates as an evaporator, and second heat exchanger 103 provides substantially no change in the temperature of working fluid 113.

On the other hand, as working fluid 113 passes from second heat exchanger 103 to first heat exchanger 102, heat exchange takes place in first heat exchanger 102 like the heat exchange described above with respect to second heat exchanger 103 operating in the heating mode. Working fluid 113 passes through the first higher temperature flow path defined by first heat exchanger 102 transferring at least some of this heat to the two-phase liquid and vapor working fluid 113 passing through the separate second lower temperature flow path (or paths) also defined by first heat exchanger 102. Thus first heat exchanger 102 transfers heat out of the working fluid 113 coming from outdoor heat transfer unit 105 causing some or all of the vapor phase working fluid 113 upstream from reversible metering device 110 to recondense to a liquid phase before entering it.

As noted above with respect to reversible heat pump system 100 operating in the heating mode, FIG. 1B illustrates as well how a dedicated cooling system such as an air conditioning system could obtain the benefit provided by first heat exchanger 102. In an air conditioning system, reversing valve 109 would be unnecessary and the output from compressor 107 could be directly connected to the inlet of downstream outdoor heat transfer unit 105. Likewise, in an air conditioning system, second heat exchanger 103 and reversible metering device 106 provide little if any additional benefit. Therefore these components could be removed as well and a direct connection made between the outlet of outdoor heat transfer unit 105 and the inlet of the first higher temperature flow path and first heat exchanger 102.

It will therefore be appreciated from the above description of FIGS. 1A and 1B, that the arrangement of heat exchangers 102 and 103 illustrated in these figures and described above provides substantially the same behavior in either the heating or cooling mode. Both operate to substantially reduce or eliminate vapor phase working fluid entering either metering device 110 or metering device 106 depending on whether the closed refrigeration circuit in reversible heat pump system 100 is operating in the cooling or the heating mode, or whether the arrangement of components shown in FIGS. 1A and 1B have been modified to only operate in either the heating or the cooling mode.

Because they are schematic in nature, no specific dimensions, placement, mode of operation, type, or presence or absence of additional components should be inferred from FIGS. 1A and 1B. For example, compressor 107 may be any device useful for increasing the pressure of working fluid 113, such as, for example, by reducing its volume. Such devices include, but are not limited to, various types of rotary compressors such as lobe compressors, screw compressors, liquid ring compressors, scroll compressors, or vane compressors. Other types of compressors include reciprocating compressors such as diaphragm compressors as well as double acting and single acting reciprocating compressors like piston or swash plate compressors, or centrifugal axial compressors. These are but a few nonlimiting possibilities of various embodiments of compressor 107.

Similarly, working fluid 113 may be any fluid suitable for transferring heat through a closed circuit refrigeration or vapor compression cycle like those illustrated in FIGS. 1A and 1B and discussed above. Examples include but are not limited to, a working fluid consisting of a mixture of Difluoromethane (CH2F2, also known as R-32) and Pentafluoroethane (CHF2CF3, also known as R-125), often mixed in equal parts and referred to by the American Society of Heating, Refrigerating, and Air Conditioning Engineers (ASHRAE) as R-410A. Other examples of working fluid 113 include Chlorodifluoromethane (CHClF2) carrying the ASHRAE designation R-22, Tetrafluoroethane (C2H2F4) referred to by ASHRAE as R-134, or a mixture of R-22 and Chloropentafluoroethane (C2F5Cl) referred to by ASHRAE as R-115, the mixture including about 48.8 percent R-22 and about 51.2 percent R-115 and referred to by ASHRAE as R-502. These are simply illustrative examples of working fluid 113, as such a working fluid may comprise any suitable chemical compositions having properties advantageous to the operation of any heat pump system or air conditioning system like those described herein.

Indoor heat transfer unit 111 and outdoor heat transfer unit 105 may be configured to exchange heat between the working fluid 113 and an external medium such as ambient air, a liquid such as water or brine, or the earth such as in a direct or indirect exchange geothermal installation. Examples of devices that may be included in outdoor heat transfer unit 105 include various types of tube and fin heat exchangers, tube-in-tube heat exchangers, and the like. Indoor heat transfer unit 111 and outdoor heat transfer unit 105 may include any suitable heat exchanger, heat exchange system, or heat exchange assembly useful for transferring heat into or out of working fluid 113 circulating within the closed refrigeration circuit used by reversible heat pump system 100.

Reference to "indoor" and "outdoor" heat transfer units 111 and 105 are exemplary references to the placement of theses heat exchange units for heating and cooling, although any suitable placement is envisioned leaving actual placement unconstrained by these names. For example, both heat transfer units 111 and 105 could include shell and tube heat exchangers positioned far apart from one another either indoors or outdoors. In another example, one heat transfer unit could include a fin and tube heat exchanger positioned inside the enclosed space while the other heat transfer unit could be a shell and tube heat exchanger located elsewhere in a different part of the same building, or in another building. Similarly, the "outdoor" heat transfer aspect could include immersing the unit in a body of liquid such as a pond or lake.

Reversible metering devices 110 and 106 illustrated in FIGS. 1A and 1B include any device or system for controlling the rate of refrigerant flow into the indoor or outdoor heat transfer units 111 or 105 respectively depending on which of the indoor or outdoor heat transfer units 111 or 105 is operating as an evaporator. One embodiment of such a device is a thermal expansion valve, although other devices with similar properties and behavior are envisioned as well.

The metering or flow control of working fluid 113 may be accomplished by various means such as using a temperature sensor coupled to the metering device. Examples of such temperature sensors include a sensing chamber or bulb containing a fluid similar to working fluid 113, or an electronic sensing device, or other suitable apparatus for sensing the temperature of working fluid 113. The temperature sensor can communicate the temperature of the working fluid vapor leaving the evaporator causing reversible metering device 110 or 106 to open or close accordingly. Reversible metering devices 110 and 106 may also include a bypass or check valve which channels working fluid 113 around the pressure and flow metering components within reversible metering devices 110 and 106 as the fluid flows through the metering device from the heat transfer unit operating as a condenser.

It should also be noted that enclosed space 114 may include various arrangements of openings such as doors and windows 115 which may be open or closed. Examples of enclosed space 114 include, but are not limited to, an office building, a commercial building, a bank, a multi-family dwelling such as an apartment building, a single family residential home, a factory, an enclosed or enclosable entertainment venue, a hospital, a store, a school, a single or multi-unit storage facility, a laboratory, a vehicle, an aircraft, a bus, a theatre, a partially and/or fully enclosed arena, a shopping mall, an education facility, a library, a boat, a ship, or other partially or fully enclosed structure.

Figure 2:
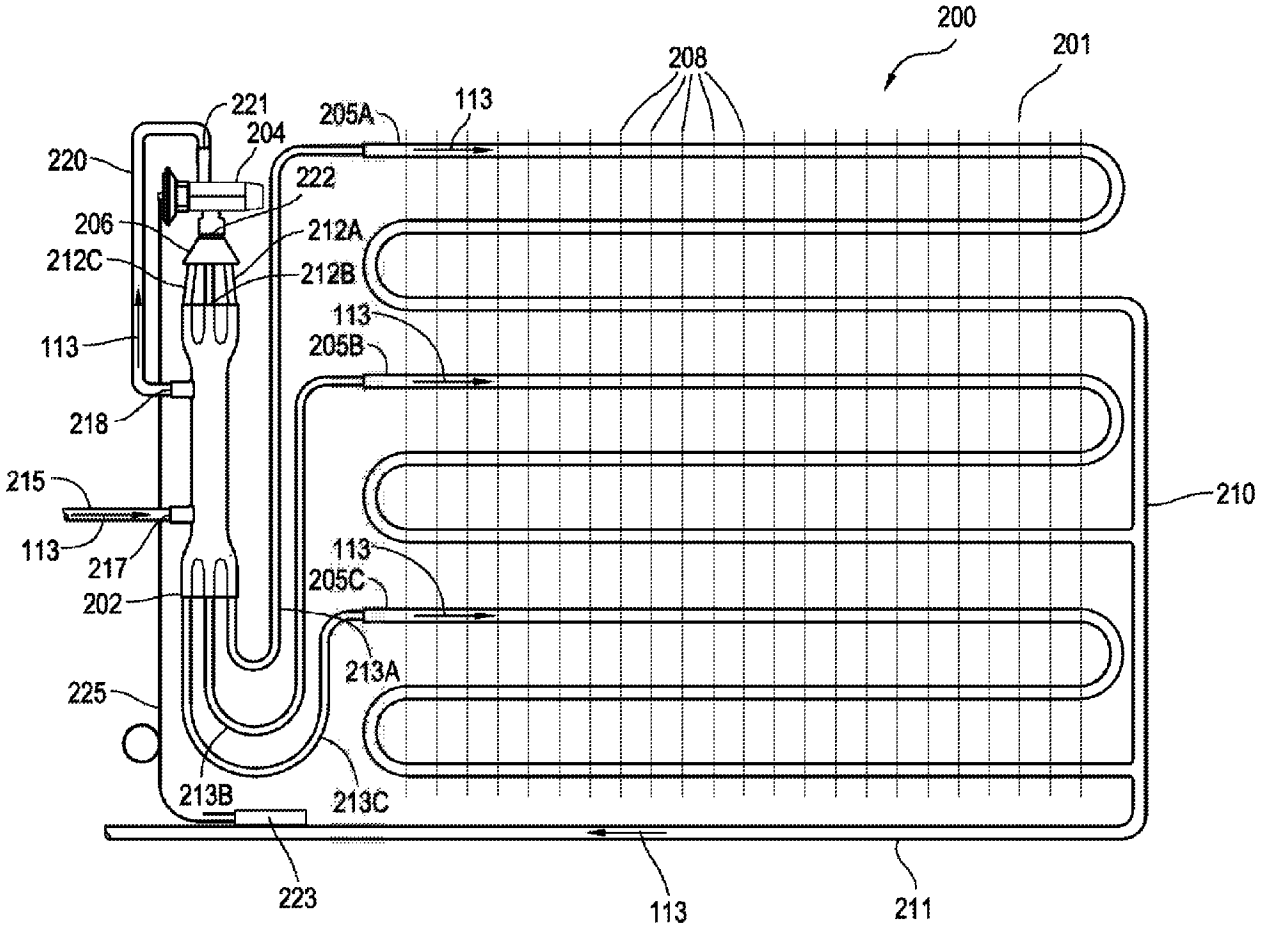
FIG. 2 is a diagrammatic view showing a portion of a closed refrigeration circuit like the ones shown in FIGS. 1A and 1B having one embodiment of a subcooling heat exchanger and a primary heat exchanger.
Figure 3A:
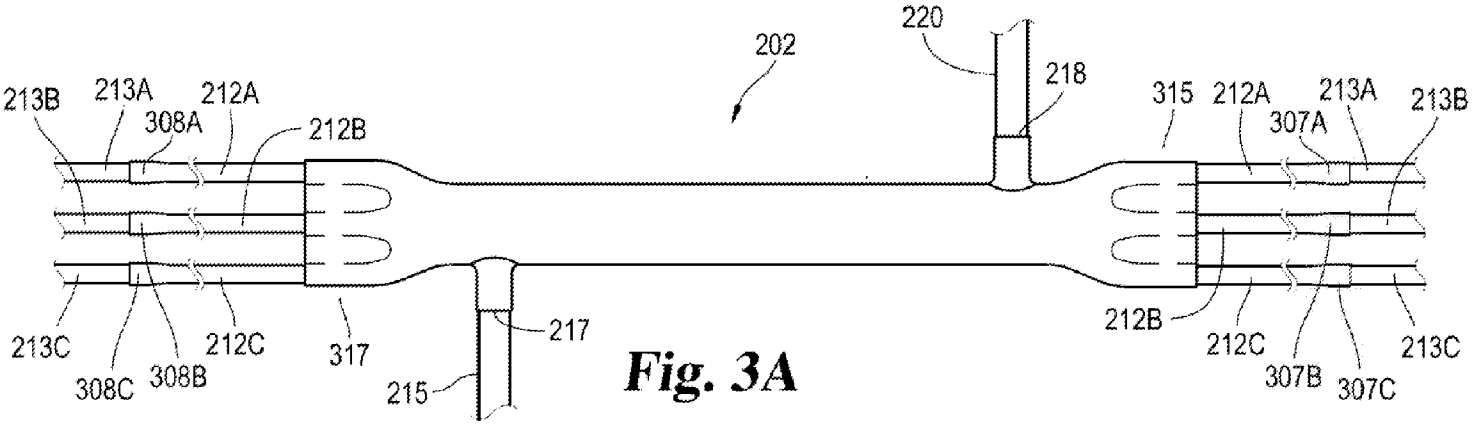
FIG. 3A is a diagrammatic view of the subcooling heat exchanger of FIG. 2.
Figure 3B:
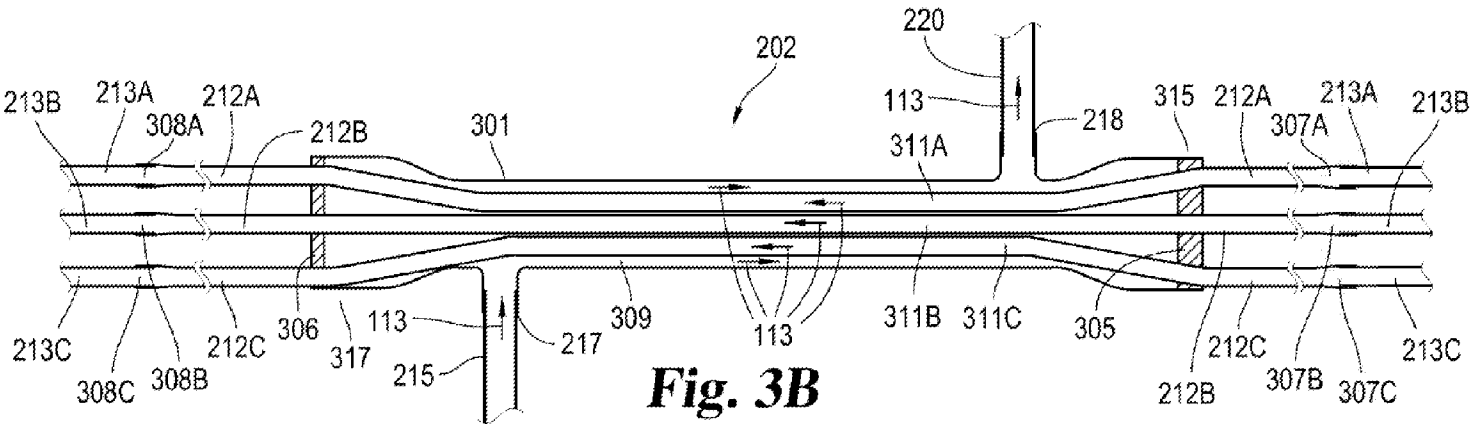
FIG. 3B is a cross-sectional view of the subcooling heat exchanger of FIG. 3A.

Illustrated in FIGS. 2, 3A, and 3B is one example of a heat exchange assembly 200 having some of the components illustrated in FIGS. 1A and 1B. Included is a primary heat exchanger 201 operating as an evaporator like either of indoor or outdoor heat transfer units 111 and 105, and a subcooling heat exchanger 202 operating like first and second heat exchangers 102 and 103. Heat exchange assembly 200 is configured to operate in a closed refrigeration circuit like the one illustrated in FIGS. 1A and 1B as part of a reversible or nonreversible refrigeration circuit also having a compressor, condenser, one or more metering devices, and possibly a reversing valve.

As illustrated in FIG. 2, working fluid 113 enters subcooling heat exchanger 202 from an upstream condenser, such as heat transfer unit 105 or 111, at a first inlet 217. Working fluid 113 passes through a first higher temperature flow path within subcooling heat exchanger 202 exiting at a first outlet 218 upstream from a reversible metering device 204. Working fluid 113 flows through a metering device inlet line 220 through metering device inlet 221. As it passes through metering device 204, the pressure is reduced and the resulting two-phase liquid and vapor phase working fluid 113 passes out of metering device 204 through a metering device outlet 222. The now cooler two-phase liquid and vapor phase working fluid 113 then flows downstream into a distributor 206. In this embodiment, metering device 204 operates like reversible metering devices 110 and 106 illustrated in FIGS. 1A and 1B and described above, selectively reducing the pressure of working fluid 113 as it passes from inlet 221 to outlet 222 while having little if any effect on the pressure and temperature of working fluid 113 if the flow is reversed.

Distributor 206 is configured to distribute the working fluid 113 through several ports into several conduits or lines such as subcooling heat exchange conduits 212A, 212B, and 212C defining several separate flow paths passing through subcooling heat exchanger 202. In other examples, some of the ports may distribute working fluid 113 directly to distribution lines 213 or various combinations of conduits 212 and distribution lines 213 (see FIG. 9). Distributor 206 may also be configured to mix the liquid and vapor phase working fluid 113 as well to, among other things, provide a substantially equal distribution of liquid and vapor phase working fluid 113 to each of the subcooling heat exchange conduits 212 (and distribution lines 213). Conduits 212 can then be coupled to corresponding distribution lines or conduits 213A through 213C to carry the distributed mixture of the liquid and vapor phase working fluid 113 to primary heat exchange conduits 205A, 205B, 205C which also define one or more flow paths through primary heat exchanger 201. As working fluid 113 passes through primary heat exchange conduits 205, the remaining liquid phase working fluid 113 can change phase from a liquid to a vapor so that receiver 210 can collect the evaporated vapors to pass them downstream through a return line 211 to a compressor such as compressor 107. The vapors may also pass through other components along the way such as a reversing valve like reversing valve 109 and various other devices as well.

It should be noted that it may be advantageous in other embodiments of heat exchange assembly 200 for more than three subcooling heat exchange conduits 212 to pass working fluid from distributor 206 to subcooling heat exchanger 202. In some examples, four, five, six or more subcooling heat exchange conduits 212 may be used. A corresponding number of distribution lines 213 and primary heat exchange conduits 205 may also be used as well thus increasing the number of flow paths through primary heat exchanger 201. However, each conduit 212 may correspond to more than one distribution line 213, and each distribution line 213 may correspond to more than one single primary heat exchange conduit 205. In some embodiments, it may be advantageous to combine or split conduits 212, distribution lines 213, and conduits 205 to accommodate various arrangements. For example, 10 conduits 212 may feed working fluid 113 into five separate distribution lines 213 corresponding to five primary heat exchange conduits 205. In another embodiment, six subcooling heat exchange conduits 212 may correspond to six distribution lines 213 which may then divide into 12 corresponding primary heat exchange conduits 205. Any suitable arrangement of conduits 212, distribution lines 213, and conduits 205 are envisioned that can allow for sufficient heat exchange in primary heat exchanger 201 and subcooling heat exchanger 202.

Distributor 206 is also shown in FIG. 2 adjacent to metering device 204, although the two devices may be physically separated by a length of conduit or by one or more other refrigeration circuit components. Similarly, distributor 206 is shown adjacent to subcooling heat exchanger 202, although subcooling heat exchange conduits 212 are shown extending outwardly away from distributor 212 before entering subcooling heat exchanger 202. Thus distributor 206 is also positioned adjacent to subcooling heat exchanger 202, although some length of one or more conduits or possibly other refrigeration circuit components may be present between the two devices. By positioning conduits between the adjacent devices, distributor 206 and subcooling heat exchanger 202 may be arranged to fit within specific positional constraints peculiar to a given installation. In other embodiments, distributor 206 may be coupled directly to subcooling heat exchanger 202 and to metering device 204 without any intervening devices or conduits between them. By placing distributor 206, metering device 204, and subcooling heat exchanger 202 adjacent one another in this manner, a compact arrangement of components may be realized.

As further illustrated in FIG. 2, a temperature sensing device 223 is positioned adjacent return line 211 for detecting changes in the temperature of working fluid 113 as the evaporated working fluid passes downstream to the compressor. Changes in the temperature are fed back to metering device 204 through a sensor line 225. Sensor line 225 may be a wire carrying digital or analog electrical signals, a tube or other conduit containing working fluid 113 or a similar fluid (either in a liquid phase, a vapor phase, or both), or any other suitable device for transmitting or transferring temperature data from temperature sensing device 223 to metering device 204.

FIGS. 3A and 3B illustrate further details of the subcooling heat exchanger 202 shown in FIG. 2. In FIGS. 3A and 3B, subcooling heat exchanger 202 has an outer shell 301 enclosing subcooling heat exchange conduits 212 which pass through subcooling heat exchanger 202 entering at a first end 315 and exiting at a second end 317. Condensed primarily liquid working fluid 113 enters through condenser line 215 feeding warm working fluid from a heat transfer unit like indoor and outdoor heat transfer units 111 or 105 into subcooling heat exchanger 202 through a first inlet 217. Inlet 217 is in fluid communication with a first higher temperature flow path 309 defined by outer shell 301, a first end block 305 at first end 315, and a second end block 306 at second end 317. The relatively warm high pressure working fluid 113, which may also include some working fluid in a vapor phase, enters first flow path 309 to travel around and between subcooling heat exchange conduits 212 inside subcooling heat exchanger 202 exiting at first outlet 218 into metering device inlet line 220. Working fluid 113 traveling along the first flow path 309 can therefore bathe, engulf, submerge, or otherwise exchange heat with subcooling heat exchange conduits 212 as it passes through subcooling heat exchanger 202 providing the opportunity for heat transfer with the working fluid 113 traveling through conduits 212.

The working fluid passes through metering device 204 and distributor 206 as illustrated in FIG. 2 to reenter and pass through subcooling heat exchanger 202 through one or more separate second flow paths 311A, 311B, and 311C defined by subcooling heat exchange conduits 212A, 212B, and 212C respectively. Working fluid 113 enters conduits 212 as either a vapor phase, a liquid phase, or a mixture of both from one or more optional distribution lines 213, or possibly directly from distributor 206. As working fluid 113 circulates through the warmer first flow path 309 and the cooler second flow paths 311, heat from the warmer working fluid 113 in first flow path 309 can transfer through conduits 212 to be absorbed by the cooler working fluid 113 passing through the separate second flow paths 311. In this way, the fluid in flow paths 311 can be warmed while cooling the working fluid in flow path 309.

As subcooling heat exchanger 202 cools the working fluid 113 in first flow path 309, it provides conditions favorable for a phase change for any a vapor phase working fluid in first flow path 309 to recondense to a liquid phase before working fluid 113 exits subcooling heat exchanger at first outlet 218. As discussed above, the cooling sufficient to recondense substantially all vapor phase working fluid in flow path 309 is likely small. Thus a first delta defined by the difference in temperature between the working fluid entering first inlet 217 and the working fluid exiting first outlet 218 can, for example, be less then 10 degrees Fahrenheit, less than 5 degrees Fahrenheit, or less than 2 degrees Fahrenheit. However, in some implementations, it may be advantageous for first delta to be larger, such as greater than or equal to 10 degrees Fahrenheit, greater than or equal to 20 degrees Fahrenheit, or greater than or equal to 30 degrees Fahrenheit in order to achieve a sufficient level of subcooling.

As discussed previously with respect to FIG. 2, FIGS. 3A and 3B illustrate several subcooling heat exchange conduits 212 by showing three separate conduits 212A, 212B, and 212C. However, any suitable number of conduits 212 is envisioned such as one, two, three, four, five, six, 10, or more. Likewise, as also discussed above, distribution lines 213 appear in FIGS. 3A and 3B individually coupled to conduits 212. However, it is envisioned that one or more conduits 212 may be coupled to one or more distribution lines 213 depending on the particular requirements of the system and the installation. Any such suitable arrangement of distribution lines 213 upstream and downstream of conduits 212 is envisioned. It is also possible that some embodiments may be directly coupled to an upstream distributor 206 thus shortening or eliminating altogether the distribution lines 213 and conduits 212 extending outwardly beyond first end 315.

Distribution lines 213 can be coupled to corresponding conduits 212 using connectors 307A, 307B, and 307C adjacent the first end 315, and using connectors 308A, 308B, and 308C adjacent second end 317. As illustrated, connectors 307 and 308 can include various connecting elements such as flanges, sleeves, or swagging into which distribution lines 213 may be inserted. Connectors 307 and 308 may also include any other suitable connecting elements for coupling conduits 212 to distribution lines 213 including threaded connectors, compression fittings, and the like. In other embodiments, distribution lines may be coupled by inserting distribution lines 213 into the connecting elements and soldering, brazing, welding, or otherwise coupling distribution lines 213 to conduits 212 to complete the closed refrigeration circuit. Another suitable alternative is for connectors 308 to be insertable into distribution lines 213 instead. Any suitable coupling capable of sealing the refrigeration circuit so as to maintain working fluid 113 within flow paths 311 and 309 is envisioned.

The flanges, sleeves, or swagging shown in FIGS. 3A and 3B provide a simple and inexpensive approach for a technician to install subcooling heat exchanger 202 as an upgrade or addition to an existing reversible heat pump system (or dedicated heating or cooling system) having a closed refrigeration circuit like the one shown in FIGS. 1A and 1B. For example, the retrofit procedure might be performed by cutting, disconnecting, or otherwise separating the distribution lines 213 running from a distributor such as distributor 206 to primary heat exchanger 201. Subcooling heat exchanger 202 may then be inserted into the closed refrigeration circuit by inserting distribution lines 213 adjacent to first end 315 into the flanges, sleeves, swagging or other connecting elements of connectors 307, and inserting distribution lines 213 leading to some other heat transfer unit such as primary heat exchanger 201 into similar connecting elements in connectors 308 adjacent second end 317. Distribution lines 213 may then be fastened by any suitable fastener, or welded, brazed, soldered, or otherwise maintained in place.

Similarly, condenser line 215 may also be separated from metering device 204 and coupled to first inlet 217 such as by inserting a length of condenser line 215 into first inlet 217 and soldering, welding, brazing, or otherwise maintaining condenser line 215 in a fluid sealed relationship with first inlet 217. Other types of connectors and coupling devices may be used as well. Metering device inlet line 220 can also be similarly coupled to first outlet 218 and metering device inlet 221, thus completing the closed refrigeration circuit. The act of inserting subcooling heat exchanger 202 may include various other acts such as evacuating some or all of the working fluid from the refrigeration circuit to avoid waste and unwanted discharge of working fluid 113. Inserting subcooling heat exchanger 202 may also include the act of recharging the closed refrigeration circuit with a suitable working fluid, a few nonlimiting examples of which are included above.

Figure 4:
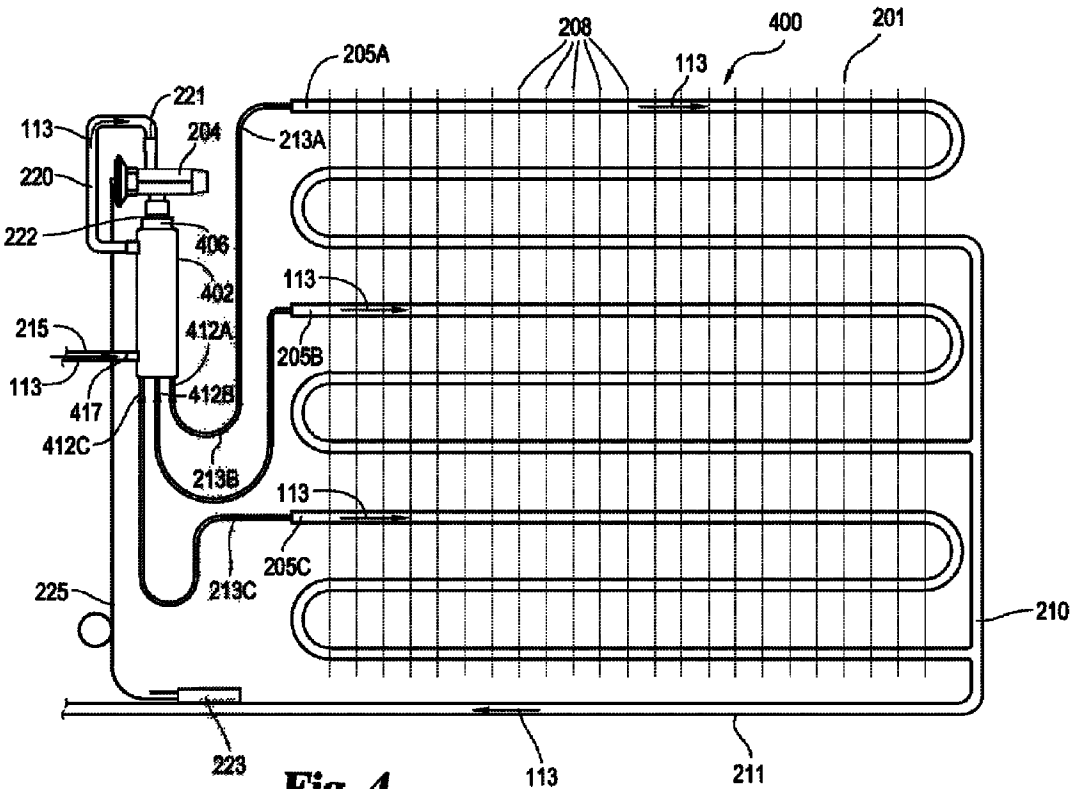
FIG. 4 is a diagrammatic view of another embodiment of a subcooling heat exchanger and primary heat exchanger like those shown in FIG. 2.
Figure 5A:
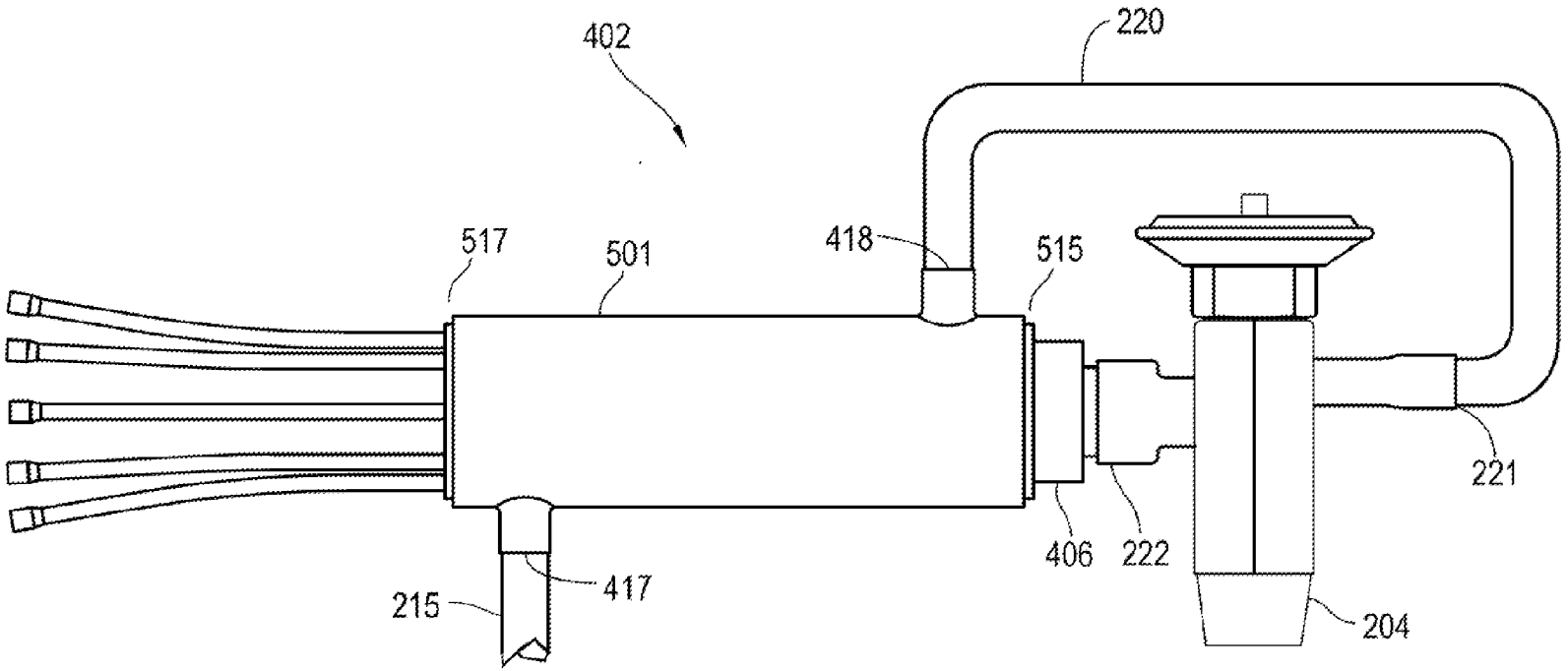
FIG. 5A is a diagrammatic view of the subcooling heat exchanger of FIG. 4.
Figure 5B:
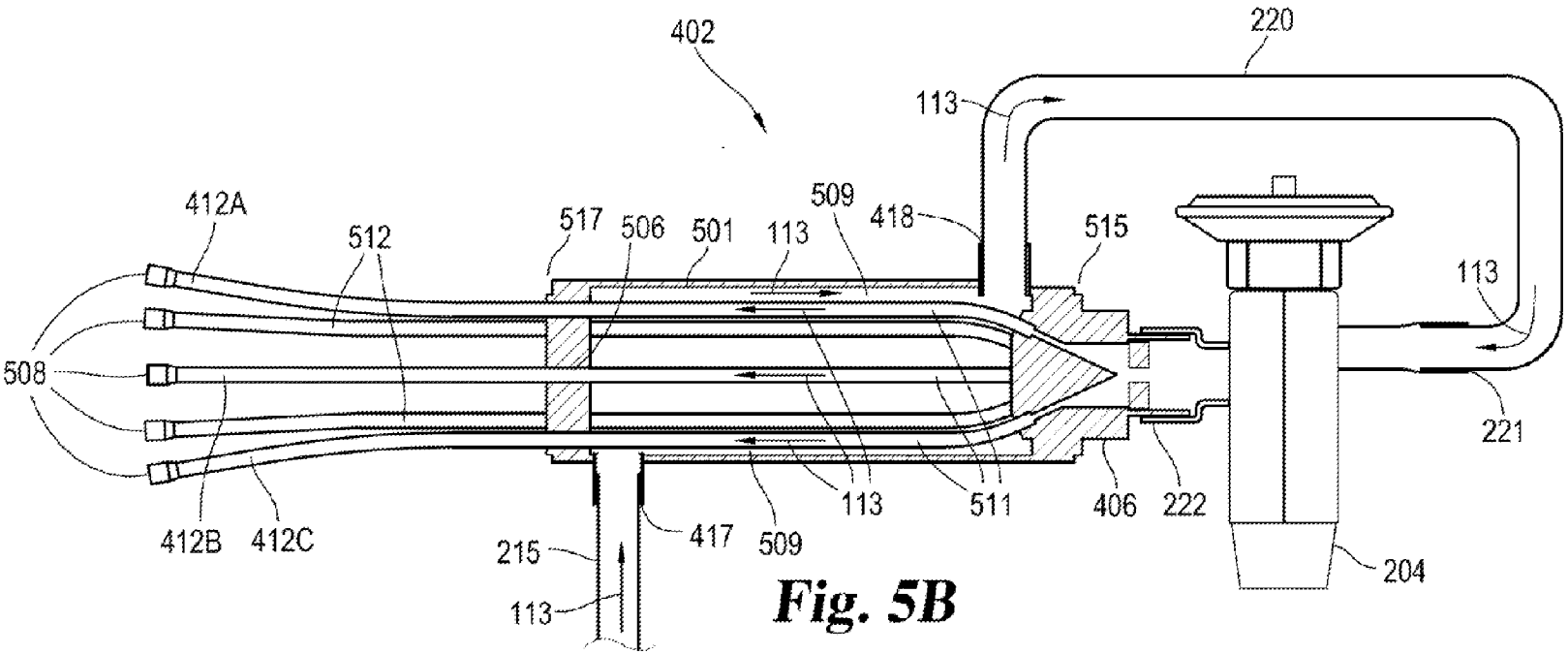
FIG. 5B is a cross-sectional view of the subcooling heat exchanger of FIG. 5A.
Figure 6:
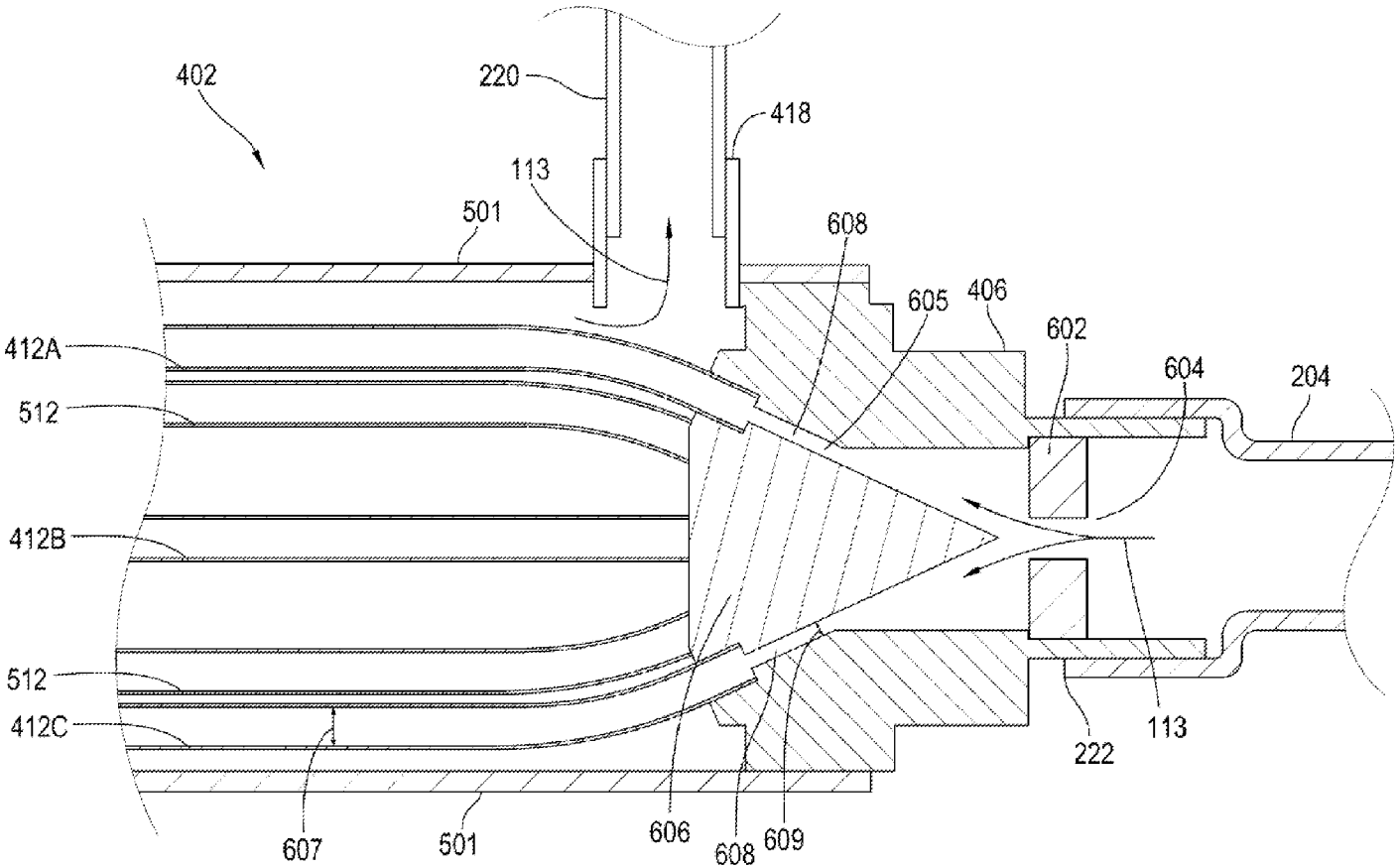
FIG. 6 is a cross-sectional view of the distributor shown in FIG. 5B.

FIGS. 4 through 6 illustrate another embodiment of a heat exchange assembly 400 like heat exchange assembly 200 discussed in detail above. Both heat exchange assembly 200 and heat exchange assembly 400 include a primary heat exchanger 201 operating as an evaporator like the indoor or outdoor heat transfer units 111 and 105 illustrated in FIGS. 1A and 1B. Heat exchange assembly 400 also includes a subcooling heat exchanger 402 which operates like subcooling heat exchanger 202 to achieve a similar subcooling affect. Like subcooling heat exchanger 202, heat exchanger 402 receives working fluid 113 through condenser line 215 into first inlet 417. The working fluid initially passes through a first higher temperature flow path within subcooling heat exchanger 402 exiting through a first outlet 418 into metering device inlet line 220. Working fluid 113 then passes through metering device 204 causing working fluid 113 to experience a pressure reduction within the metering device 204. The warm condensed working fluid 113 "flashes" to form a combination of liquid and vapor phase fluid 113 at a lower temperature and pressure. The resulting liquid and vapor phase working fluid 113 passes through a distributor 406 and into subcooling heat exchanger 402.

Like distributor 206, distributor 406 distributes the liquid and vapor phase working fluid 113 into several subcooling heat exchange conduits 412 illustrated in FIG. 4 as 412A, 412B, and 412C. However, as with previous examples, there may be any suitable number of conduits 412 such as one, two, three, four, five, seven, ten, or more. Like subcooling heat exchange conduits 212, subcooling heat exchange conduits 412 define one or more second lower temperature flow paths separate from the first higher temperature flow path. Subcooling heat exchange conduits 412 pass through subcooling heat exchanger 402 and can extend to primary heat exchanger 201 providing a flow of working fluid 113 to one or more primary heat exchange conduits 205. Like heat exchanger assembly 200, one or more distribution lines 213 may also be coupled to subcooling heat exchange conduits 412 and to primary heat exchange conduits 205 as illustrated in FIG. 4. As discussed above, any number of subcooling heat exchange conduits 412 may be coupled to any number of primary heat exchange conduits 205 optionally using one or more of the distribution lines 213. For example, subcooling heat exchanger 402 may include 5 subcooling heat exchange conduits 412 which may then couple to 10 distribution lines 213—which may themselves be coupled to 15 primary heat exchange conduits 205. Any suitable arrangement of subcooling heat exchange conduits 212, distribution lines 213, and primary heat exchange conduits 205 is conceivable.

FIGS. 5A and 5B illustrate further detail of subcooling heat exchanger 402 which includes an outer shell 501 containing, or partially containing distributor 406 at a first end 515 and an end block 506 at a second end 517. First inlet 417 allows working fluid 113 to enter a first flow path 509 defined by outer shell 501, end block 506, and distributor 406, and through which the warmer condensed fluid from the condenser passes on its way to metering device 204. Like the working fluid in first flow path 309, the working fluid 113 traveling along first flow path 509 may pass around subcooling heat exchange conduits 412 along the way coating, submerging, or otherwise exchanging heat with them. Like subcooling heat exchanger 202, a temperature difference, or first delta, can develop between working fluid 113 entering at first inlet 417 and the working fluid 113 exiting the first flow path at first outlet 418. Also like subcooling heat exchanger 202, this first delta may, for example, be less then 10 degrees Fahrenheit, less than 5 degrees Fahrenheit, or less than 2 degrees Fahrenheit. However, in some implementations, it may be advantageous for first delta to be greater than or equal to 10, 20, or 30 degrees Fahrenheit, or more, to achieve a sufficient level of subcooling.

After passing through metering device 204, working fluid 113 (now a two-phase combination of a liquid and vapor phase) continues downstream into distributor 406 through first end 515 where it is mixed and divided, preferably equally or evenly, between subcooling heat exchange conduits 412. As discussed above, no limit to the number of heat exchange conduits 412 should be presumed from any of the present figures. For example, two additional subcooling heat exchange conduits 512 are illustrated which if present would also receive a substantially equal portion of the two-phase liquid and vapor mixture leaving distributor 406. Regardless of the number, subcooling heat exchange conduits 412, and 512 define one or more separate second flow paths 511 for carrying the working fluid from the metering device through the heat exchanger to the evaporator, the working fluid in the first higher temperature flow path 509 exchanging heat with working fluid in the second lower temperature flow paths 511 defined by the conduits 412 and 512.

Like subcooling heat exchanger 202, subcooling heat exchanger 402 may also be introduced into a new or previously existing closed refrigeration circuit such as the circuit used in reversible heat pump system 100, or other similar circuit operating in a dedicated heating or cooling mode. In this respect, heat exchanger 402 may be used in a refrigeration circuit as another example of first and second heat exchangers 102 and 103. As with subcooling heat exchanger 202 discussed above, subcooling heat exchanger 402 includes connectors 508 having sleeves, flanges, swagging, or other connecting elements. Like connectors 307 and 308, connectors 508 may be of any suitable type that would allow subcooling heat exchanger 402 to be coupled to distribution lines 213, or primary heat exchange conduits 205 such as by threaded connectors, compression fittings, brazing, welding, soldering, and the like. In this way, subcooling heat exchanger 402 may also be introduced into a closed refrigeration circuit as part of an original equipment installation during manufacturing, or later as a retrofit or add-on using procedures similar to those described with respect to subcooling heat exchanger 202 above.

Additional structural details of distributor 406 appear in FIG. 6 where an enlarged cross-sectional view is shown. The combination of a liquid and vapor phase working fluid 113 passes downstream from metering device 204 through metering device outlet 222 into distributor 406. Working fluid 113, in the illustrated embodiment, encounters an optional flow restrictor 602 which operates as a mixing device to substantially evenly mix the liquid and vapor phase working fluid 113 which may have separated by the force of gravity or other forces after leaving metering device 204. Separated liquid and vapor phase working fluid 113 entering distributor 406 may result in some primary heat exchange conduits 205 having more or less liquid phase working fluid 113 then others possibly reducing the efficiency of primary heat exchanger 201. Therefore optional flow restrictor 602 operates as a mixing device to counteract any separating of the liquid and vapor phases that may have occurred and is one technique for enhancing overall performance in primary heat exchanger 201. However, in some embodiments of distributor 406, flow restrictor 602 may by absent as the liquid and vapor phase working fluid 113 may already be sufficiently mixed by other methods or devices as it enters distributor 406.

The liquid and vapor phase working fluid 113 passing into distributor 406 is then divided in the illustrated embodiment by a divider 606 illustrated as a tapered member in the cross-section. Examples include a conical or wedge shaped member having a unitary molded structure that along with the rest of distributor 406 defines several ports 608 providing working fluid 113 to the subcooling heat exchange conduits 412 and 512. The ports 608 as shown have a first cross-section 609 that is smaller than a second cross section 607 defined by the heat exchange conduits 412 and 512.

In the illustrated embodiment, subcooling heat exchange conduits 412 and 512 have similar second cross sections 607, although in other embodiments the cross-section of each individual conduit may vary. Also, ports 608 may correspond to individual conduits 412 and 512, although in other embodiments one port 608 may provide working fluid 113 to one or more conduits 412 and 512 as well. It may also be advantageous to manufacture distributor 406 and outer shell 501 as a single piece rather than the two separate pieces shown.

Figure 7:
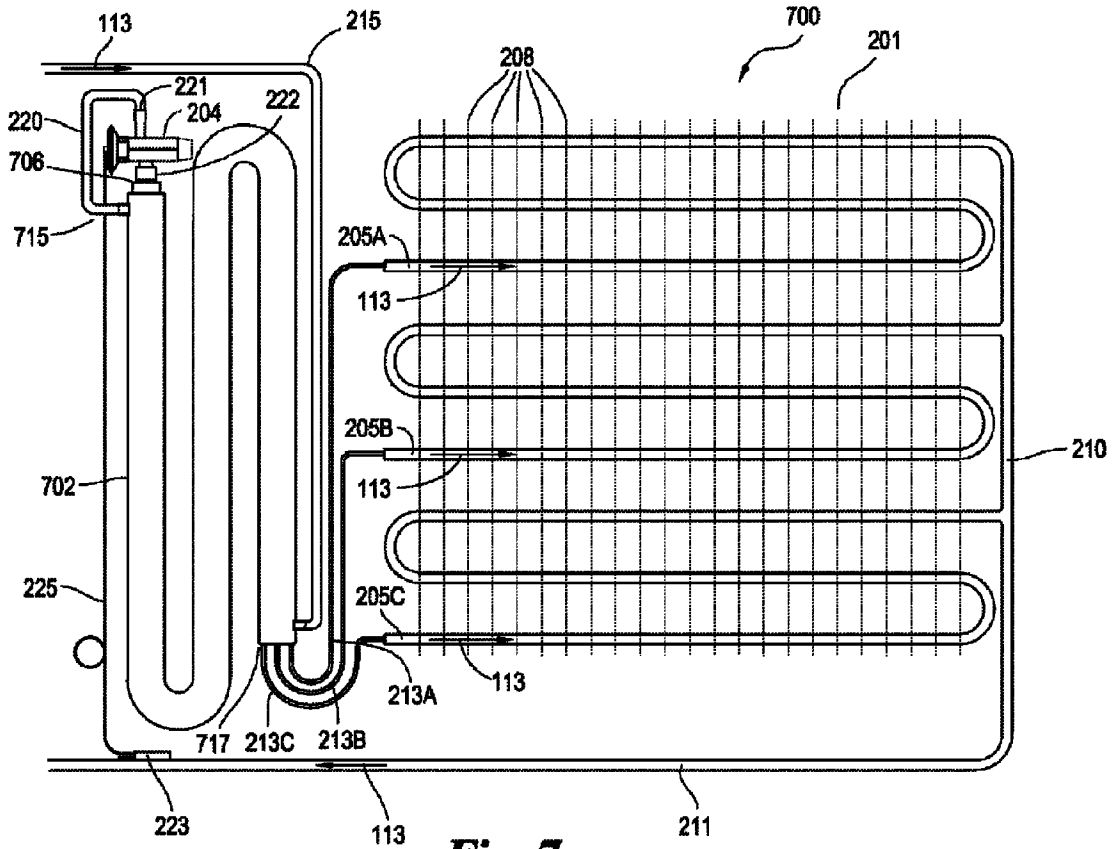
FIG. 7 is a diagrammatic view of another embodiment of a subcooling heat exchanger and primary heat exchanger like those shown in FIGS. 2 and 4.

FIG. 7 illustrates a subcooling heat exchanger 702 as part of a heat exchange assembly 700 similar in construction to subcooling heat exchanger 402, and operates like subcooling heat exchangers 202 and 402. Working fluid 113 passes through the condenser line 215 from an upstream condenser to enter subcooling heat exchanger 702 where it passes through a first higher temperature flow path like first flow path 509 exiting subcooling heat exchanger 702 to enter a downstream metering device 204. Metering device 204 causes the previously discussed pressure drop and creation of two-phase liquid and vapor working fluid 113. The liquid and vapor phase working fluid 113 enters distributor 706 at a first end 715 and flows into separate second lower temperature flow paths which are arranged like second flow paths 511. The working fluid passes through these second flow paths as discussed above with respect to subcooling heat exchangers 202 and 402 finally exiting a second end 717 to enter several primary heat exchange conduits 205 optionally using several distribution lines 213 as well.

Subcooling heat exchanger 702 illustrates an example of how the heat exchanger components disclosed herein (such as subcooling heat exchangers 202, 402, and others) may include conduits and flow paths of virtually any length. Therefore, it should be understood that no particular limitation should be inferred by the figures with regard to the lengths, widths, cross-sections, diameters, or other dimensions of any of the disclosed conduits, lines, flow paths, heat exchangers, and the like from any figures or descriptions included herein. For example, adding additional length between first end 715 and second end 717, and additional corresponding length to the internal first and second flow paths provides for additional heat exchange within subcooling heat exchanger 702. A similar relationship also exists with heat exchangers 201, 202, and 402 (and any others herein disclosed) wherein a change in the length, size, diameter, or number of first and second flow paths can result in faster or slower heat exchange.

Figure 8:
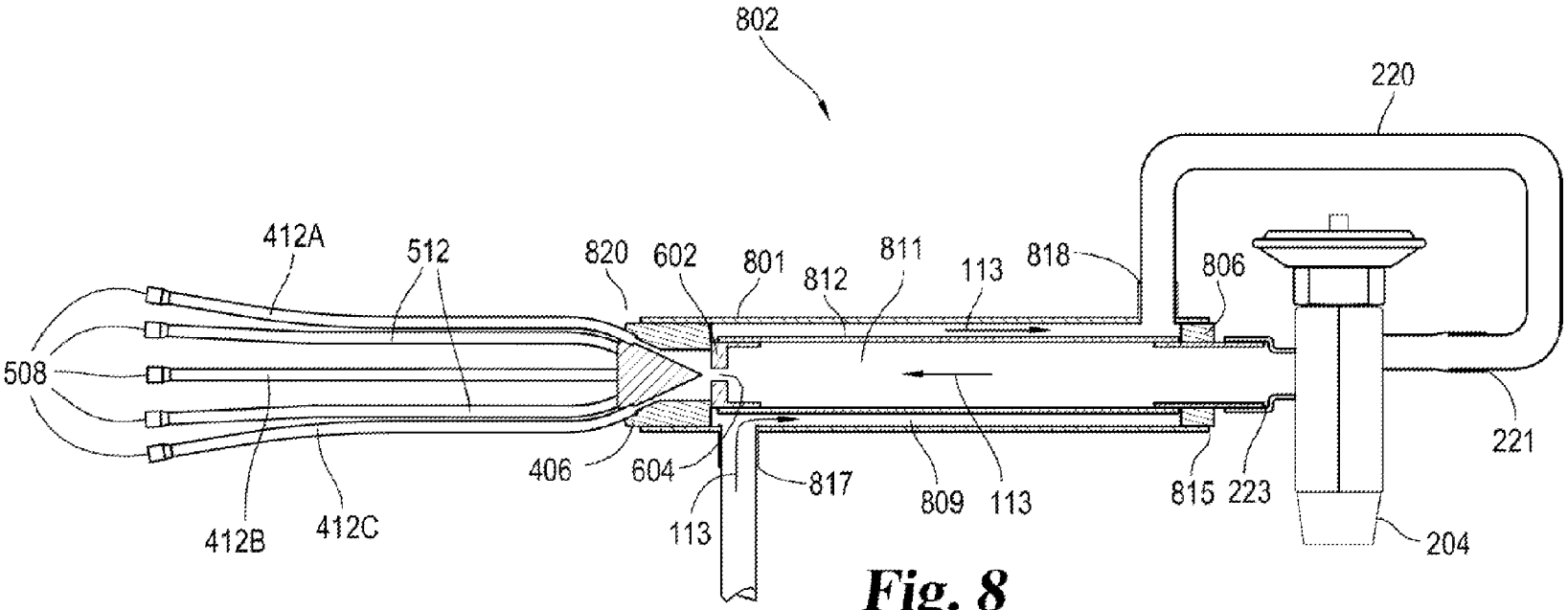
FIG. 8 is a cross-sectional view of another embodiment of a subcooling heat exchanger like the heat exchanger shown in FIG. 5B.

FIG. 8 illustrates yet another embodiment of a subcooling heat exchanger 802 having a first flow path defined by an outer shell 801, an end block 806 at a first end 815, and a distributor 406 at a second end 820. Like subcooling heat exchangers 202, 402, and 702, working fluid 113 enters a first higher temperature flow path 809 at first inlet 817 from condenser line 215. Like the fluid flowing through paths 309 and 509, the warm condensed fluid passes over and around a separate second flow path 811 for working fluid 113 defined by an inner shell 812. Working fluid 113 is carried into metering device 204 through metering device inlet line 220 where it experiences a substantial pressure reduction. The resulting two-phase liquid and vapor working fluid 113 enters the lower temperature separate second flow path 811 to exchange heat with the warmer working fluid 113 in first flow path 809. The combination of liquid and vapor phase working fluid is then distributed to subcooling heat exchange conduits 412 (and optionally 512) through distributor 406 as discussed above. Subcooling heat exchanger 802 thus operates like subcooling heat exchangers 202, 402, and 702 discussed above to achieve a level of subcooling sufficient to recondense some or substantially all of the vapor phase working fluid which may be present in the first higher temperature flow path 809.

In FIG. 8, subcooling heat exchanger 802 is adjacent metering device 204 and distributor 406, in this case upstream of distributor 406 and downstream of metering device 204. It is also shown in FIG. 8 that metering device 204 and distributor 406 are directly coupled to heat exchanger 802. However such a direct coupling arrangement is optional. No particular constraint exists with respect to the distance between components as noted above.

Figure 9:
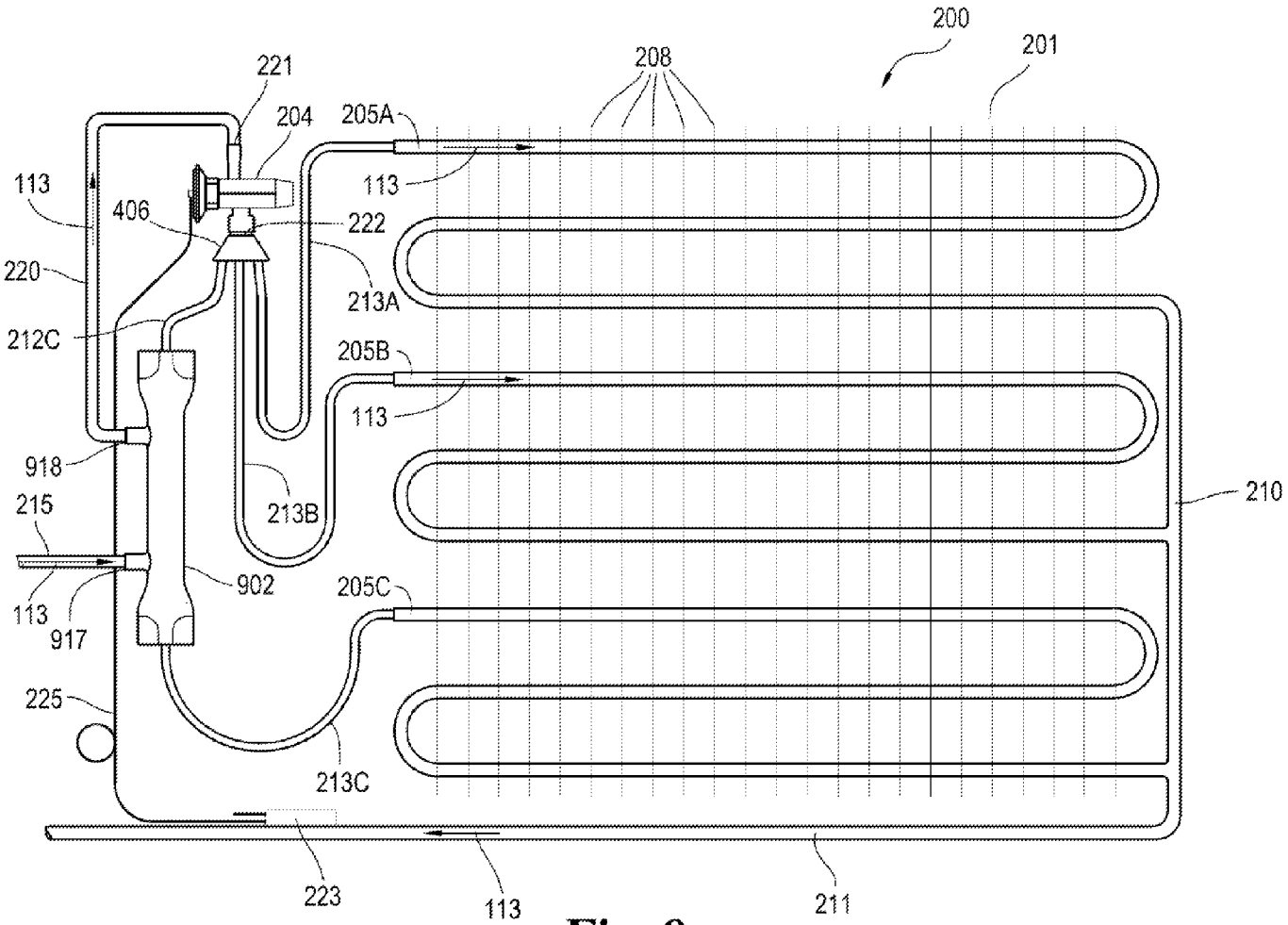
FIG. 9 is a diagrammatic view of another embodiment of a subcooling heat exchanger and primary heat exchanger like those shown in FIG. 2.

FIG. 9 illustrates yet another embodiment of a subcooling heat exchanger 902 similar to subcooling heat exchanger 202 shown in FIG. 2. FIG. 9 gives an example of a subcooling heat exchanger exchanging heat between the warm liquid condensate and a single distribution conduit. Heat exchanger 902 has a first inlet 917 and a first outlet 918 like first inlet 217 and first outlet 218. Working fluid 113 enters first inlet 217 from condenser line 215 as a warm condensed liquid which may or may not contain some vapor as well. The working fluid passes through a first higher temperature flow path defined by subcooling heat exchanger 902 exiting first outlet 918 to flow through metering device inlet line 220. Working fluid 113 passes through metering device inlet 221 into metering device 204 which causes working fluid 113 to reduce in pressure and separate into a liquid and a vapor phase as discussed in detail above. The liquid and vapor phase exit through metering device outlet 222 into distributor 406 for distribution into one or more flow paths in primary heat exchanger 201. Further detail showing the flow of working fluid 113 through distributor 406 is illustrated in FIG. 6 and described in detail above The working fluid passes through distributor 406 flowing through ports 608 as described above into distribution lines or conduits 213A through 213C. Like FIG. 2, distribution lines 213 define one or more flow paths to the downstream evaporator. In FIG. 9, a heat exchange conduit 212C also defines a portion of one of the flow paths carrying the working fluid through subcooling heat exchanger 902 in a second, lower temperature flow path that is like the flow paths 311 shown in FIG. 3B. This lower temperature flow path then exchanges heat with the higher temperature flow path (similar to flow path 309) as described above in the preceding examples to reduce the temperature of the working fluid in the higher temperature flow path while increasing the temperature of the fluid in the lower temperature flow path. Working fluid 113 passes through the lower temperature flow path and into distribution line 213C to exchange heat with an external medium in the primary heat exchanger 201 as described above.

Although FIG. 9 illustrates three distribution lines or conduits 213 defining three distribution flow paths, this arrangement is only exemplary and not restrictive. For example, another arrangement includes two heat exchange conduits 212 passing through subcooling heat exchanger 902 passing working fluid 113 to one or more distribution lines 213 while two other distribution lines 213 pass directly from distributor 206 to primary heat exchanger 201. In another example, four heat exchange conduits 212 pass through heat exchanger 902 and into four distribution lines 213 while two distribution lines 213 pass directly from distributor 206 to primary heat exchanger 201. Any combination of flow paths passing the working fluid through subcooling heat exchanger 902 and flow paths passing the working fluid directly to the primary heat exchanger 201 are envisioned. Furthermore, as discussed above, any number of distribution lines 213 may pass working fluid 113 to any number of primary heat exchange conduits 205 in primary heat exchanger 201.

It should also be noted that in the preceding illustrated examples of a subcooling heat exchanger 202, 402, 702, 802, and 902 the first higher temperature flow path, and the second lower temperature flow paths may be shown with working fluid 113 flowing in generally opposite directions. This "counter current" flow behavior through the disclosed subcooling heat exchangers may be desirable to achieve an increase in heat exchanger performance, but is optional. Further examples of heat exchangers are envisioned such as subcooling heat exchangers like those disclosed but with inlets and outlets for the first higher temperature flow paths (e.g. 217 and 218, or 817 and 818 and others) placed at the same end of the heat exchanger, or in other locations. The may result in first and second flow paths carrying working fluid 113 in at least somewhat the same direction rather than in opposing or at least in different directions.

It may also be advantageous to arrange the inlets, outlets, or other aspects of the heat exchangers disclosed herein to create radial flows around the inner circumference or inner surface of the outer shell as well. Some degree of radial movement may be inherent in the arrangement of inlets and outlets shown in FIGS. 3A, 3B, 5A, 5B, 8 and others where working fluid 113 enters at one side of the first flow path and passes across or around the first flow path to reach the exit on an opposite side.

It should also further be noted that conduits or lines 112, 212, 412, 205, and others, may be constructed of any suitable material capable of containing the working fluid under pressure as it passes through the closed refrigeration circuits envisioned herein. Thus these lines and conduits may be constructed of any suitable material such as metal, plastic, rubber and the like. The lines may be rigid, semi-rigid, or flexible, and may include various internal or external coatings, sleeves, or other layers providing various benefits such as added durability or an increase or decrease in heat transfer (for example insulative properties). In many cases it may appear, or be suggested by the drawings that the lines or conduits or other components in the figures have a particular shape, such as a round or ovular shape. Because the figures and description are exemplary rather than restrictive, no inference should be made as to the particular cross-sectional shape of any of the preceding components. Although a generally circular cross-section may appear in many of the figures, any of the disclosed structures may be formed using any suitable cross-sectional shape such as a circle, oval, square, octagon, or other shape regardless of how they may appear in the figures.

It should be noted that any recitation of ranges of values herein are merely intended to serve as a shorthand method of referring individually to each separate value falling within the range, unless otherwise indicated, and each separate value is incorporated into the specification as if it were individually recited herein. All methods described can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the invention unless otherwise claimed. No language in the specification should be construed as indicating any non-claimed element as essential to the practice of the invention.

The detailed descriptions and illustrations included herein are to be considered as illustrative and not restrictive in character, it being understood that only some embodiments have been shown and described and that all changes and modifications that come within the spirit of the invention are desired to be protected. In addition, all references cited herein are indicative of the level of skill in the art and are hereby incorporated by reference in their entirety.

What is claimed is:

1. A subcooling heat exchanger using several evaporator distribution lines, comprising:

a compressor, a condenser, a metering device, and an evaporator coupled together to form a closed refrigeration circuit for circulating a working fluid; and a heat exchanger upstream from the evaporator, the heat exchanger defining a first flow path carrying a working fluid from the condenser to the metering device, wherein the heat exchanger has several separate conduits defining several separate second flow paths carrying the working fluid from the metering device through the heat exchanger to the evaporator, and wherein the working fluid in the first flow path exchanges heat with the working fluid in the second flow paths.

2. The subcooling heat exchanger of claim 1, further comprising a distributor downstream from the metering device receiving a liquid and a vapor phase working fluid from the metering device, the distributor having a mixing device for creating a mixture of the liquid and the vapor phase, and a flow divider for distributing the mixture to the several conduits defining the several second flow paths.

3. The subcooling heat exchanger of claim 2, wherein the mixture is substantially equally distributed amongst the several conduits.

4. The subcooling heat exchanger of claim 2, wherein the distributor is adjacent the heat exchanger.

5. The subcooling heat exchanger of claim 2, wherein the distributor is adjacent the metering device.

6. The subcooling heat exchanger of claim 2, wherein the mixing device comprises a flow restrictor defining an opening through which the liquid and the vapor phase can pass.

7. The subcooling heat exchanger of claim 2, wherein the distributor defines several ports upstream from the conduits, and a first cross section of the ports is smaller than a second cross section of the conduits.

8. The subcooling heat exchanger of claim 1, wherein the heat exchanger has 3 or more second flow paths.

9. The subcooling heat exchanger of claim 1, further comprising a first end and a second end, wherein the several separate second flow paths are defined by conduits extending past the first end adjacent the metering device.

10. The subcooling heat exchanger of claim 1, wherein the heat exchanger is adjacent the metering device.

11. A subcooling heat exchanger positioned between a metering device and a distributor, comprising:

a compressor, a condenser, a metering device, and an evaporator coupled together to form a closed refrigeration circuit for circulating a working fluid;

a heat exchanger defining a first higher temperature flow path carrying the working fluid from the condenser to the metering device, and a separate second lower temperature flow path carrying the working fluid in a liquid and a vapor phase from the metering device through the heat exchanger to the evaporator, the working fluid in the first flow path exchanging heat with the working fluid in the separate second flow path; and a distributor downstream from the metering device receiving the liquid and vapor phase working fluid from the second lower temperature flow path, the distributor having a mixing device for creating a mixture of the liquid and vapor phase, and a flow divider for distributing the mixture to the evaporator downstream from the distributor through several conduits.

12. The subcooling heat exchanger of claim 11, wherein the mixing device comprises a flow restrictor defining an opening through which the liquid and vapor phases pass.

13. The subcooling heat exchanger of claim 11, wherein the distributor defines several ports upstream from the conduits, and a first cross section of the ports is smaller than a second cross section of the conduits.

14. The subcooling heat exchanger of claim 11, wherein the mixture of the liquid and the vapor phase is substantially equally distributed between the several conduits.

15. The subcooling heat exchanger of claim 11, wherein the distributor is adjacent the heat exchanger.

16. The subcooling heat exchanger of claim 11, wherein the heat exchanger has 3 or more conduits.

17. The subcooling heat exchanger of claim 11, wherein the heat exchanger is adjacent the metering device.

18. A subcooling heat exchanger using at least one evaporator distribution line, comprising:

a compressor, a condenser, a metering device, and an evaporator coupled together to form a closed refrigeration circuit for circulating a working fluid;

a distributor downstream from the metering device receiving a liquid and vapor phase working fluid from the metering device, the distributor having a mixing device for creating a mixture of the liquid and vapor phase, and a flow divider for distributing the mixture to the evaporator downstream from the distributor through one or more separate distribution flow paths; and a heat exchanger defining a first higher temperature flow path carrying the working fluid from the condenser to the metering device, the working fluid in the first higher temperature flow path exchanging heat with the working fluid in at least one of the one or more separate distribution flow paths passing through the heat exchanger.

19. The subcooling heat exchanger of claim 18, wherein at least one separate distribution flow path passes through the heat exchanger, and at least one other separate distribution flow path passes outside the heat exchanger.

20. The subcooling heat exchanger of claim 18, wherein the mixing device comprises a flow restrictor defining an opening through which the liquid and vapor phases pass.

21. The subcooling heat exchanger of claim 18, wherein the separate distribution flow paths are defined by conduits, and the distributor defines ports upstream from the conduits having a first cross section that is smaller than a second cross section of the conduits.

22. The subcooling heat exchanger of claim 18, wherein the mixture of the liquid and the vapor phase is substantially equally distributed between the separate distribution flow paths.

23. The subcooling heat exchanger of claim 18, wherein the distributor is adjacent the heat exchanger.

24. The subcooling heat exchanger of claim 18, further comprising three or more distribution flow paths.

25. The subcooling heat exchanger of claim 18, wherein the heat exchanger is adjacent the metering device.

26. The subcooling heat exchanger of claim 1, wherein the several separate conduits are coupled to the metering device and the evaporator, and wherein the evaporator is configured to receive the working fluid from the metering device through the several separate conduits.

* * * * *